United States Patent [19]

Tamagawa et al.

[11] Patent Number: 4,567,497

[45] Date of Patent: Jan. 28, 1986

[54] HEAT-SENSITIVE RECORDING PAPER

[75] Inventors: Shigehisa Tamagawa; Tetsuro Fuchizawa, both of Shizuoka, Japan

[73] Assignee: Fuji Photo Film Co., Ltd., Kanagawa, Japan

[21] Appl. No.: 708,456

[22] Filed: Mar. 5, 1985

[30] Foreign Application Priority Data

Mar. 5, 1984 [JP] Japan ..... 59-41735

[51] Int. Cl.[4] ..... B41M 5/18

[52] U.S. Cl. ..... 346/200; 346/226; 427/150; 427/151; 427/152; 428/537.5

[58] Field of Search ..... 346/200, 209, 226; 427/150, 151, 152; 428/511, 512, 513, 514, 537.5, 913, 914

[56] References Cited

FOREIGN PATENT DOCUMENTS 0098393 6/1982 Japan ..... 346/200

*Primary Examiner*—Bruce H. Hess

*Attorney, Agent, or Firm*—Sughrue, Mion, Zinn, Macpeak and Seas

[57] ABSTRACT

A heat-sensitive recording paper is described, comprising a paper support and a heat-sensitive color-forming layer on the paper support, wherein the paper support contains a cationic softening agent, such as a maleic anhydride copolymer/polyalkylenepolyamine reaction product. This recording paper is excellent both in high-speed recording and curling properties.

6 Claims, No Drawings

HEAT-SENSITIVE RECORDING PAPER

FIELD OF THE INVENTION

The present invention relates to a heat-sensitive recording paper which is used to record, for example, with a thermal head or a heat pen. More particularly, it is concerned with a heat-sensitive recording paper which is free from the problem of a heat-sensitive color-forming layer adhering to the thermal head and accumulating on the termal head, and permits recording images of high sharpness and high density even in high-speed recording, and furthermore is reduced in curling.

BACKGROUND OF THE INVENTION

Recent advances in facsimile devices, including printers therefore, have been remarkable. In these devices, a heat-sensitive recording system that is widely used utilizes a combination of a thermal head and a heat-sensitive recording paper with a coating of a colorless dye such as crystal violet lactone and a phenol compound, as described, for example, in Japanese Patent Publication No. 14039/70.

The heat-sensitive recording system has many advantages. For example, since the recording paper is of the primary color formation type, a conventional type development step is not needed, and the recording unit can be simplified. Therefore, the production costs for the recording paper and recording unit are low. Also, since recording is of the non-impact type, it is not noisy. Thus, heat-sensitive recording has gained a position as a low-speed recording system. However, a major disadvantage of the heat-sensitive recording system is that it is low in recording speed compared with other recording systems, such as electrostatic recording. For this reason, the heat-sensitive recording system has not yet been employed in circumstances wherein high-speed recording is required.

The main reason for which high-speed recording cannot be attained by the heat-sensitive recording system is that heat conduction cannot be achieved sufficiently quickly between the thermal head and the heat-sensitive recording paper coming into contact with the thermal head, and thus sufficient recording density can not be obtained if high speed recording is attempted. The thermal head, comprising electric resistor heat-generators combined together in a dot-form, generates heat upon receipt of a recording signal and melts a heat-sensitive color-forming layer in contact with the thermal head, thereby allowing it to form color. In order to attain recording of high sharpness and high density, it is necessary that dot reproductivity be good. That is, it is necessary that the thermal head and the heat-sensitive color-forming layer come into as close contact as possible and heat conduction be carried out with high efficiency so that a completely colored dot conforming to the shape of the dot heat generator of the thermal head is formed in the heat-sensitive color-forming layer in a manner completely correspondent to a high-speed recording signal. In fact, however, only several percent of the amount of heat generated from the thermal head is conducted to the heat-sensitive color-forming layer; the efficiency of heat conduction is extremely low. Several methods have been proposed to increase the smoothness of the heat-sensitive color-forming layer so that the thermal head and the heat-sensitive color-forming layer come into as close contact as possible with each other.

Japanese Patent Publication No. 20142/77 describes a method in which the surface of the heat-sensitive color-forming layer is treated so that the surface smoothness as represented in terms of Beck smoothness is from 200 to 1,000 seconds. Japanese Patent Application (OPI) No. 115255/79 (the term "OPI" as used herein means a "published unexamined Japanese patent application") describes that when the Beck smoothness is from 200 to 1,000 seconds, the heat-sensitive color-forming layer can respond only to heat impulses of from about 5 to 6 milliseconds, and that for high-speed recording using heat impulses of less than 1 millisecond it is necessary for the surface of the heat-sensitive color-forming layer to be made smooth to such an extent that the Beck smoothness is more than 1,100 seconds. However, when the Beck smoothness is increased to more than 1,100 seconds, color fog is produced upon application of pressure. The formation of color fog is prevented by using a base paper which has been previously made smooth to an extent that the Beck smoothness is more than 500 seconds. Japanese Patent Application (OPI) No. 156086/78 describes that the surface roughness, Ra, of the heat-sensitive color-forming layer is made to be less than 1.2 $\mu$m, and the glossiness less than 25%.

In all the above-described prior art techniques, the smoothness of the heat-sensitive color-forming layer is increased only by calender processings such as super calendering, machine calendering, and gloss calendering. This calendering is applied to the base paper alone, or the base paper and the heat-sensitive paper, or the heat-sensitive paper alone. In the heat-sensitive recording paper, however, as the smoothness is increased by the calendering in order to increase the recording density, adherence and accumulation are increased. In practical use, therefore, the smoothness is suppressed to a suitable level so that the recording density and the occurrence of adherence and accumulation are properly balanced. In the prior art techniques, regardless of the smoothness level, the resulting heat-sensitive recording paper is unsuitable for practical use for high-speed recording in respect of recording density and recording stability.

The term "adherence" (sticking) as used herein refers to a phenomenon wherein the thermal head adheres to the heat-sensitive color-forming layer, thereby producing stripping noise and lowering the dot reproductivity. The term "accumulation" (piling) refers to a phenomenon wherein heat-melted products of the heat-sensitive color-forming layer accumulate on the thermal head, thereby lowering the recording density and dot reproductivity. Both of these phenomena inhibit stable recording.

Another disadvantage as encountered in applying the calender processing to the heat-sensitive recording paper is that color fog is formed by pressure, resulting in an increase in the density of the background of the recording paper. Similarly, in the calendering processing of the base paper, so-called cockle, wrinkles, etc. due to unevenness in basis weight develop. Thus it is limited in its practical use. As described above, the attempt to increae the smoothness of the heat-sensitive color-forming layer by calendering processing so as to increase the recording density has met with only limited success, and the resulting heat-sensitive recording paper is not sufficiently satisfactory for use in high-speed recording.

Furthermore, heat-sensitive recording paper is usually used in the condition that it is wound on a paper tube several inches in diameter. Thus, since it is stored in the above condition, curling at the core portion is liable to occur. It has long been desired to overcome this curling problem.

SUMMARY OF THE INVENTION

The present invention is intended to overcome the above-described problems, and an object of the present invention is to provide a heat-sensitive recording paper which produces a high recording density and is reduced in curling when stored in the condition that it is wound on a small paper tube.

It has now been found that the object is attained by increasing the flexibility of the base paper through incorporation of cationic softening agents in a paper support; that is, a heat-sensitive recording paper having both the above-described properties can be obtained by incorporating such cationic softening agents into the paper support.

Accordingly, the present invention relates to a heat-sensitive recording paper comprising a paper support and a heat-sensitive color-forming layer on the paper support wherein the paper support contains a cationic softening agent.

DETAILED DESCRIPTION OF THE INVENTION

Softening agents which are used in the present invention are cationic softening agents that are self-fixing to cellulose. These softening agents are described in *Shin Kami Kako Binran,* edited by Shigyo Times Co., Ltd., Japan, pages 554–555. Particularly preferred are those agents having a molecular weight of at least 200, and more particularly those agents having a hydrophobic group containing at least 10 carbon atoms and also having an amine salt or quaternary ammonium salt self-fixing to cellulose. Typical examples of such softening agents are reaction products of maleic anhydride copolymers and polyalkylenepolyamine, reaction products of higher fatty acids and polyalkylenepolyamine, and quaternary ammonium salts of higher fatty acids, as described, for example, in Japanese Patent Application (OPI) No. 116705/75. Of these compounds, reaction products of maleic anhydride copolymers and polyalkylenepolyamine are particularly preferred.

These softening agents can be incorporated into the base paper by two methods, viz., internal addition and surface sizing. The internal addition is preferred in that the effect thereby is greater.

As the amount of the softening agent added is increased, the effect becomes greater. However, if the amount of the softening agent added is too large, the strength of the paper is decreased, leading to problems, e.g., in paper cutting. Furthermore, it is economically disadvantageous. Thus the amount of the softening agent added is preferably from 0.01 to 1.0% by weight, based on the dry weight of the pulp in the paper support, more preferably 0.1 to 0.5% by weight.

In order to obtain the effects of the softening agent more efficiently, it is desirable that sizing agents be used in combination therewith. The reason for this is that if sizing agents are used in combination, a reduction in the smoothness of the base paper due to coating of a heat-sensitive coating solution or coating solution for the preparation of the heat-sensitive color-forming layer can be minimized. Sizing agents which can be preferably used include rosin, alkylketene dimers, higher fatty acid salts, paraffin wax, and alkenylsuccinic acid. The weight ratio of the softening agent to the sizing agent is preferably from 1/100 to 10/1, more preferably 1/20 to 5/1, from the viewpoint of a balance between the desired effect and a reduction in the strength of the paper.

The base paper that is used in the present invention is produced mainly from wood pulp such as NBKP, LBKP, NBSP, and LBSP. In addition, it can be produced from mixtures of wood pulp and synthetic fibers such as vinylon or synthetic pulp such as polyethylene. From the viewpoint of flexibility, it is preferred that the freeness of the pulp be such that it is not almost beaten. However, taking into consideration the formation and paper production suitability, the Canadian Standard freeness of the pulp is preferably from 200 to 500 cc (C.S.F.). Fillers such as clay, talc, calcium carbonate, and urea resin fine particles, sizing agents such as rosin, alkylketene dimers, higher fatty acid salts, paraffin wax, and alkenylsuccinic acid, and fixing agents such as aluminum sulfate and cationic polymers may be added, if desired. In addition, surface sizing using pigments such as calcium carbonate and kaolin, starch, polyvinyl alcohol, and SBR latexes may be applied. Furthermore, the back of the base paper may be coated with a coating solution such as a film-forming polymer for the purpose of preventing curling.

The heat-sensitive coating solution as used herein will hereinafter be explained.

A color former and a color developer are dispersed independently in the respective water-soluble polymer solutions, for example, by means of a ball mill. In the case of the ball mill, a finely divided dispersion of the color former or color developer is prepared by using balls having different diameters in a suitable mixing ratio, and dispersing the resulting mixture over a sufficiently long period of time. It is also effective, for example, to use a model sand mill (trademark, Dyno mill).

The thus-prepared color former and color developer dispersions are mixed, and inorganic pigments, waxes, higher fatty acid amides, and metallic soaps, and, if desired, further ultraviolet absorbers, antioxidants, latex binders, etc., are added thereto to prepare the desired coating solution. These additives may be added during the dispersing process.

The coating solution is coated on a support in such a manner that the amount of the color former coated is from 0.2 to 1.0 g/m$^2$.

The color former used herein is not critical; color formers commonly used in pressure-sensitive and heat-sensitive recording papers, for example, can be used in the present invention. Typical examples of such color formers are shown below.

(1) Triarylmethane-based compounds:

3,3-bis(p-dimethylaminophenyl)-6-dimethylaminophthalimide (crystal violet lactone), 3-(p-dimethylaminophenyl)-3-(1,2-dimethylindol-3-yl)phthalide, 3-(p-dimethylaminophenyl)-3-(2-phenylindol-3-yl)phthalide, 3,3-bis(p-ethylcarbazol-3-yl)-3-dimethylaminophthalide, and 3,3-bis(2-phenylindol-3-yl)-5-dimethylaminophthalide.

(2) Diphenylmethane-based compounds:

4,4-bis-dimethylaminobenzhydrin benzyl ether, N-halophenyl leuco auramine, and N-2,4,5-trichlorophenyl leuco auramine.

(3) Xanthene-based compounds:

Rhodamine B-anilinolactam, 3-diethylamino-7-dibenzylaminofluoran, 3-diethylamino-7-butylaminofluoran, 3-diethylamino-7-(2-chloroanilino)fluoran, 3-diethylamino-6-methyl-7-anilinofluoran, 3-piperidino-6-methyl-7-anilinofluoran, 3-ethyl-tolylamino-6-methyl-7-anilinofluoran, 3-cyclohexylmethylamino-6-methyl-7-anilinofluoran, 3-diethylamino-6-chloro-7-(β-ethoxyethyl)aminofluoran, 3-diethylamino-6-chloro-7-(γ-chloropropyl)aminofluoran, 3-diethylamino-6-chloro-7-anilinofluoran, 3-N-cyclohexy-N-methylamino-6-methyl-7-anilinofluoran, and 3-diethylamino-7-phenylfluoran.

(4) Thiazine-based compounds:

Benzoyl leuco methylene blue, and p-nitrobenzoyl leuco methylene blue.

(5) Spiro-based compounds:

3-methyl-spiro-dinaphthopyran, 3-ethyl-spirodinaphthopyran, 3-benzylspiro-dinaphthopyran, and 3-methyl-naphtho-(3-methoxy-benzo)-spiropyran.

They can be used singly or in combination with each other. The color former is selected depending on the particular purpose of the heat-sensitive recording paper and the desired characteristics.

As color developers which are used in the present invention, phenol derivatives and aromatic carboxylic acid derivatives are preferred. Particularly preferred are bisphenols. Typical examples of such phenol compounds are p-octylphenol, p-tert-butylphenol, p-phenylphenol, 2,2-bis(p-hydroxy)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, and 2,2-bis(4-hydroxy-3,5-dichlorophenyl)propane. Typical examples of aromatic carboxylic acid derivatives are p-hydroxybenzoic acid, propyl p-hydroxybenzoate, butyl p-hydroxybenzoate, benzyl p-hydroxybenzoate, 3,5-di-α-methylbenzylsalicyclic acid, and polyvalent metal salts thereof. The preferred amount of the color developer coated is from 0.5 to 2.0 g/m$^2$.

In order that the color developer melts at the desired temperature and undergoes a color-forming reaction, it is preferred that the color developer be added as a eutectic mixture in combination with a heat-fusible substance having a low melting point, or in the state that such a low melting substance is fused to the surface of color developer particles.

Waxes which can be used include paraffin wax, carnaba wax, microcrystalline wax, and polyethylene wax. In addition, higher fatty acid amides such as stearic acid amide, ethylenebisstearoamide, higher fatty acid esters, etc., can be used.

Metallic soaps which can be used include higher fatty acid polyvalent metal salts such as zinc stearate, aluminum stearate, calcium stearate, and zinc oleate.

Inorganic pigments which can be used include kaolin, calcined kaolin, talc, agalmatolite, diatomaceous earth, calcium carbonate, aluminum hydroxide, magnesium hydroxide, magnesium carbonate, titanium oxide, and barium carbonate.

For these inorganic pigments it is preferred that the amount of oil absorbed is at least 60 ml/100 g and the average particle diameter, 5 μm or less. In the case of oil-absorbing inorganic pigments, it is desirable that they be compounded in the recording layer in a dry amount of from 5 to 50% by weight, with the range of from 10 to 40% by weight being preferred.

They are dispersed in a binder and coated. In general, water-soluble binders are used for this purpose, including polyvinyl alcohol, hydroxyethyl cellulose, hydroxypropyl cellulose, an ethylene/maleic anhydride copolymer, a styrene/maleic anhydride copolymer, an isobutylene/maleic anhydride copolymer, polyacrylic acid, starch derivatives, casein, and gelatin.

Compounds for providing water-resistance (i.e., gelling agents and cross-linking agents), and hydrophobic polymer emulsions such as a styrene/butadiene rubber latex and an acryl resin emulsion can be added for the purpose of imparting water resistance to the above binders.

The amount of the binder in the recording layer is from 10 to 30% by weight, indicated as dry weight. In addition, if desired, other auxiliary additives such as defoaming agents, fluorescent dyes, and coloring dyes may be added to the coating solution.

In the formation of the recording layer, the above coating solution can be coated by known coating techniques, such as blade coating, air knife coating, gravure coating, roll coating, spray coating, dip coating, bar coating, and extrusion coating.

The amount of the coating solution coated on the support is not critical; it is usually from 3 to 15 g/m$^2$, indicated as dry weight, with the range of from 4 to 10 g/m$^2$ being preferred.

One of advantages obtained by using the softening agents of the present invention is that the softness of the base paper is increased, as a result of which the contact area between the recording paper and the thermal head is increased during recording and a high recording density can be obtained. Another advantage is that the flexibility of the base paper is increased, and thus a heat-sensitive recording paper which exhibits reduced curling can be obtained.

The present invention is described in greater detail with reference to the following examples. Unless otherwise indicated, all parts, percents, ratio, and the like are by weight.

EXAMPLE 1

100 parts of LBKP was beaten until the Canadian freeness reached 350 cc. Then 0.2 part of polyamidepolyamine epichlorohydrin (trademark: Kymen 557, produced by Dick Hercules Co., Ltd.), 0.1 part of alkylketene dimer (trademark: Aquapel, produced by Dick Hercules Co., Ltd.), and 0.2 part of a maleic acid-based softening agent (trademark: GZ-1600, produced by Hamano Kogyo Co., Ltd.) were added. The mixture was processed in a Fourdrinier wire machine to produce a base paper (basis weight: 50 g/m$^2$; thickness: 60 μm).

COMPARATIVE EXAMPLE 1

A base paper was produced in the same manner as in Example 1, except that the softening agent was not added.

EXAMPLE 2

100 parts of LBKP was beaten until the Canadian freeness reached 350 cc. Then 1 part of rosin, 2 parts of aluminum sulfate, and 0.2 part of a maleic acid-based softening agent (trademark: GZ-1200, produced by Hamano Kogyo Co., Ltd.) were added. The mixture was processed in a Fourdrinier wire machine to produce a base paper (basis weight: 50 g/m$^2$).

COMPARATIVE EXAMPLE 2

A base paper was produced in the same manner as in Example 2, except that the softening agent was not added.

A heat-sensitive coating solution was coated on the base papers produced in Examples 1 and 2, and Comparative Examples 1 and 2, to produce heat-sensitive papers.

Preparation of Heat-Sensitive Coating Solution 20 kg of crystal violet lactone was placed in a 300-liter ball mill along with a 10% aqueous solution of polyvinyl alcohol (degree of saponification: 98%; degree of polymerization: 500), and dispersed therein over a 24 hour period. Similarly, 20 kg of 2,2-bis(4-hydroxyphenyl)propane was placed in a 300-liter ball mill along with a 10% aqueous solution of polyvinyl alcohol and dispersed therein over a 24 hour period. The thus-prepared dispersions were mixed in such a manner that the weight ratio of crystal violet lactone to 2,2-bis(4-hydroxyphenyl)propane was 1:5. In addition, 5 kg of finely divided calcium carbonate was added to 20 kg of the above-prepared mixture and thoroughly dispersed to prepare the desired coating solution.

Coating of the Heat-Sensitive Coating Solution

The coating solution was coated on one surface of the base paper by the use of an air knife coater in a solid amount of 6 g/m$^2$, dried in a hot air drier maintained at 50° C., and machine calendered.

The above-produced heat-sensitive papers were subjected to heat-sensitive recording and measured for the recording density. The heat-sensitive papers were each wound on a paper pipe 2 inches in diameter and stored for 5 months at 20° C. and 60% RH (relative humidity). At the end of the period, they were evaluated for curling.

Recording and Measurement of Density

Solid coloration was performed under conditions of recording speed: 2 milliseconds per dot; recording density in a main scanning direction: 5 dots/mm; recording density in a sub-scanning direction: 6 dots/mm; and energy of termal head: 50 millijoules/mm$^2$. The recording density was determined by measuring reflective density at 610 nm.

The results are shown in the Table below.

TABLE

| Run No. | Recording Density | Reproductivity of Dot | Curling (*1) (mm) |
|---|---|---|---|
| Example 1 | 1.10 | excellent | 11 |
| Example 2 | 1.08 | " | 12 |
| Comparative Example 1 | 0.92 | good | 48 |
| Comparative Example 2 | 0.88 | good | 42 |

Note:
(*1) Average value of heights of the four corners of an A4-sized sample.

It can be seen from the results that the heat-sensitive recording paper of the present invention is superior both in high-speed recording and curling characteristics.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a paper support and a heat-sensitive color-forming layer on the paper support, wherein the paper support contains a cationic softening agent.

2. A recording paper as in claim 1, wherein the softening agent is selected from the group consisting of a maleic anhydride copolymer/polyalkylenepolyamine reaction product, a higher fatty acid/polyalkylenepolyamine reaction product, and quaternary ammonium salts of higher fatty acids.

3. A recording paper as in claim 2, wherein the softening agent is a maleic anhydride copolymer/polyalkylenepolyamine reaction product.

4. A recording paper as in claim 1, wherein the amount of the softening agent is from 0.01 to 1.0% by weight based on the dry weight of pulp forming the paper support.

5. A recording paper as in claim 1, wherein said paper support contains a sizing agent, and the weight ratio of the softening agent to the sizing agent is from 1/100 to 10/1.

6. A recording paper as in claim 5, wherein said sizing agent is selected from the group consisting of rosin, alkylketene dimers, higher fatty acid salts, paraffin wax, and alkenylsuccinic acid.

* * * * *